United States Patent [19]

Otsu et al.

[11] Patent Number: 4,840,863

[45] Date of Patent: Jun. 20, 1989

[54] POSITIVELY CHARGEABLE TONER FOR USE IN DRY ELECTROPHOTOGRAPHY

[75] Inventors: Akira Otsu; Hiroshi Nagase, both of Tokyo, Japan

[73] Assignee: Fujikura Kasei Co., Ltd., Tokyo, Japan

[21] Appl. No.: 38,822

[22] Filed: Apr. 15, 1987

[30] Foreign Application Priority Data

Apr. 17, 1986 [JP] Japan ..... 61-87075

[51] Int. Cl.[4] ..... G03G 9/08

[52] U.S. Cl. ..... 430/110; 430/904

[58] Field of Search ..... 430/110, 904

[56] References Cited

U.S. PATENT DOCUMENTS

| | | | |
|---|---|---|---|
| 4,291,112 | 9/1981 | Lu | 430/110 |
| 4,299,898 | 11/1981 | Williams et al. | 430/110 |
| 4,397,935 | 8/1983 | Ciccarelli | 430/110 |
| 4,756,991 | 7/1988 | Grubb | 431/110 |

*Primary Examiner*—John L. Goodrow

*Attorney, Agent, or Firm*—Wenderoth, Lind & Ponack

[57] ABSTRACT

A positively chargeable toner for use in dry electrophotography, said toner comprising (A) a resinous binder composed of at least one resin selected from copolymers of styrene and/or alpha-methylstyrene with alkyl (meth)acrylates, polyester resins and epoxy resins, (B) 1 to 100 parts by weight, per 100 parts by weight of the resinous binder, of a copolymer containing a quaternary ammonium salt group, said copolymer having a weight average molecular weight of from 2,000 to 10,000 and composed of 65 to 97% by weight of recurring units represented by the formula

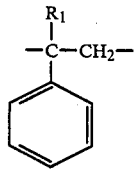

(I)

wherein $R_1$ represents a hydrogen atom or a methyl group, and 35 to 3% by weight of recurring units represented by the formula

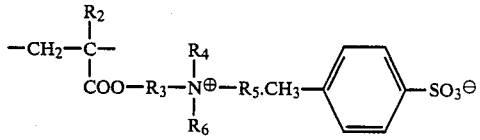

(II)

wherein $R_2$ represents a hydrogen atom or a methyl group, $R_3$ represents an alkylene group, and each of $R_4$, $R_5$ and $R_6$ represents an alkyl group, and (C) a coloring agent.

15 Claims, No Drawings

POSITIVELY CHARGEABLE TONER FOR USE IN DRY ELECTROPHOTOGRAPHY

This invention relates to a toner for use in dry electrophotography, and more specifically, to a positively chargeable toner for use in dry electrophotography to develop a latent electrostatic image to a visible image.

Toners used in developing a latent electrostatic image to a visible image in dry electrophotography are generally produced by pre-mixing a thermoplastic resin, a coloring agent and a charge controlling agent and optionally a magnetic powder and other additives, melt-kneading the mixture, pulverizing and classifying the mixture to form colored particles (to be referred to as "toner particles") having a desired particle diameter. Those toner particles which do not contain a magnetic powder are called a two-component toner, and when they are mixed and agitated with a separately prepared magnetic powder, a certain amount of a positive or negative charge is built up on the surface of the toner particles, and the charged particles are used in developing a latent electrostatic image. Those toner particles which have a magnetic powder dispersed therein are called a one-component toner, and a positive or negative charge is built up on the surface of the toner particles by friction between the toner particles themselves or between the toner particles and a development sleeve or the like. The one-component toner is likewise used in developing a latent electrostatic image.

The charge triboelectrically built up on the surface of the toner particles should be either a positive or a negative charge depending upon the type of a photoelectric conductor used in forming a latent electrostatic image, and the amount of the charge should be sufficient to develop the latent electrostatic image accurately to a visible image. It is the general practice therefore to control the polarity of the electric charge and the amount of the charge on the surface of the toner particles by dispersing a charge controlling agent or an electrically conductive substance in a binder used in the toner particles.

In recent years, there has been a rapid increase in the demand for organic photoconducting materials ("OPC photosensitive materials") having the characteristics of non-toxicity, low cost and free maintenance in place of a selenium photosensitive material for the formation of a latent electrostatic image. The use of a good positively chargeable toner is desired for the development of a latent electrostatic image formed on the OPC photosensitive material. In the case of using the selenium photosensitive material, too, the use of a positively chargeable toner is necessary for reversal development. Furthermore, in color copying, the toner should desirably be a positive chargeable toner in which the ingredients other than the coloring agent are colorless, clear and haze-free and can be colored in a desired color.

The toner particles are produced by dispersing a positive charge controlling agent, a coloring agent, and optionally a magnetic powder and other additives in a binder. Some general examples of the positive charge controlling agent used heretofore are listed below.

(1) Azine-type nigrosines, nigrosine bases and nigrosine derivatives.

(2) Metal salts of naphthenic acid and higher fatty acids.

(3) Alkoxylated amines.

(4) Organic quaternary ammonium salts such as benzylmethyl hexyldecyl ammonium chloride and decyl trimethyl ammonium chloride.

(5) Alkylamides.

Since, however, these positive charge controlling agents, are complex in structure and require troublesome production and purification steps, they do not have a constant quality, and suffer from the defect of poor stability and reliability. This raises many problems in quality control as well as in controlling toner production steps. A further disadvantage is that these positive charge controlling agent are susceptible to decomposition and degeneration by thermal and mechanical effects during the melt-kneading and pulverizing steps in the production of toner particles by dispersing them in thermoplastic resins as binders, and consequently tend to decrease in their ability to control charges. As a result, there is a tendency to marked variations in toner characteristics among production lots of the resulting toner particles or within a single production lot.

Furthermore, since these positive charge controlling agent have poor compatibility with thermoplastic resin binders, toners produced by using them have poor transparency so that when they are dyed in a desired color for use in color copying, they cannot give color copies having a brilliant clear hue.

These positive charge controlling agents, as is the coloring agent, are present in the form of dispersed particles in the binder. However, since the charge controlling agents have poor compatibility and have no element which can be fixed to the binder, the dispersed particles of the charge controlling agents present on the surface layer of the toner particles may drop off in fluidization and friction within a copying machine at the time of pulverization in toner particle production or of accumulating electric charges on the surface of the tone particles. This leads to the defect that the amount of charge on the toner particles varies or the chargeability of the toner particles varies from particle to particle. This defect increases as the number of copying cycles increases and therefore the time during which the toner particles are subjected to fluidization and friction becomes longer. It is difficult therefore to maintain a stable charged condition over an extended period of time. In an attempt to solve this problem, a method was proposed to improve the compatibility of such a positive charge controlling agent with the binder by reating it with a higher fatty acid or the like (see, for example, U.S. Pat. No. 3,893,935). It is still not satisfactory, however.

Other methods proposed to improve the compatibily of the positive charge controlling agent include a method which comprises introducing a positively chargeable vinyl polymerizable monomer having a functional group (amino group) into the skeleton of a binder resin by copolymerization to provide a positively chargeable binder (see, for example, European patent application Publication No. 5334/1979), and a method in which a quaternary salt of a polymer of a dialkylaminoacryl-amide or methacryl-amide is used as a positive charge controlling agent (see, for example, U.S. Pat. No. 4,415,696). The method of the above European patent application Publication No. 5334/1979 has the defect that since the positively chargeable functional group of the copolymer is an amino group, the toner particles give off an offensive amine odor during production or use, and moreover, the amount of charge varies owing to coloration caused by oxidation and to moisture absorption. The defect of coloration brings about the disadvantage that color toners which give a clear color hue cannot be obtained. The variation in the amount of charge leads to the disadvantage that a toner image of high and uniform quality cannot be obtained. The method described in U.S. Pat. No. 4,415,646 does not sufficiently improve the compatibility of the charge controlling agents, and has the defect of forming a white haze to the binder. As a result, a haze-free color toner of a clear hue is difficult to obtain, and the toner particles obtained have poor moisture resistance and charging stability.

It is an object of this invention to solve the aforesaid problems of the positive charge controlling agents, such as the low stability and the poor stability of the charge controlling agent with the binder, and to provide a positively chargeable toner for use in dry electrophotography which has stable chargeability, and in which the positive charge controlling agent can be dispersed as colorless or pale-colored transparent particles in a resinous binder so that the toner can be used also as a color toner.

Thus, according to this invention, there is provided a positively chargeable toner for use in dry electrophotography, said toner comprising (A) a resinous binder composed of at least one resin selected from copolymers of styrene and/or alphamethylstyrene with alkyl (meth)acrylates, polyester resins and epoxy resins, (B) 1 to 100 parts by weight, per 100 parts by weight of the resinous binder, of a copolymer containing a quaternary ammonium salt group, said copolymer having a weight average molecular weight of from 2,000 to 10,000 and composed of 65 to 97% by weight of recurring units represented by the formula

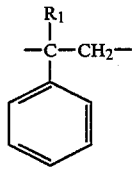

(I)

wherein $R_1$ represents a hydrogen atom or a methyl group, and 35 to 3% by weight of recurring units represented by the formula

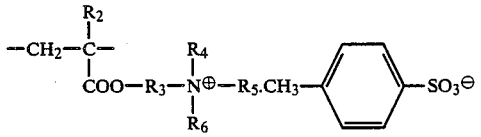

(II)

wherein $R_2$ represents a hydrogen atom or a methyl group, $R_3$ represents an alkylene group, and each of $R_4$, $R_5$ and $R_6$ represents an alkyl group, and (C) a coloring agent.

The positively chargeable toner of this invention comprises a combination of the resinous binder (A) and the copolymer (B) containing a quaternary ammonium salt group. The copolymer (B) imparts positive charging characteristics having excellent durability and stability to the binder resin (A) and at the same time can be dispersed as transparent or pale-colored transparent particles in the resinous binder (A). Hence, the toner of this invention can also be conveniently applicable to color copying.

The term "lower", as used in the present specification and the appended claims to qualify groups or compounds, means that the groups or compounds so qualified have not more than 10, preferably not more than 5, carbon atoms.

The "alkyl group" and the "alkylene group" are each a linear, branched or cyclic monovalent or divalent aliphatic hydrocarbon group. Examples of the alkyl group include those having 1 to 10 carbon atoms such as methyl, ethyl, n- or iso-propyl, n-, sec-, iso- or tert-butyl, n-, sec-, iso- or tert-amyl, n-, sec-, iso- or tert-hexyl, n-, sec-, iso- or tert-octyl, n-sec-iso- or tert-nonyl, n-, sec-, iso- or tert-decane, cyclohexyl and cyclopentyl. Of these, lower alkyl groups are preferred. Examples of the alkylene group are linear or branched alkylene groups having 2 to 3 carbon atoms such as ethylene and propylene.

The weight average molecular weight ($\overline{M}w$) and number average molecular weight ($\overline{M}n$) of the polymer or resin are determined by gel permeation chromatography using a sample of the polymer or resin and a polystyrene standard both in tetrahydrofuran.

The positively chargeable toner of this invention will be described in detail below.

(A) Resinous Binder

In the present invention, at least one resin selected from copolymers of styrene and/or alpha-methylstyrene with alkyl (meth)acrylates, polyester resins and epoxy resins is used as a resinous binder of the toner. Such resins may be selected from known binder resins used heretofore in dry electrophotographic toners.

1. Copolymers of styrene and/or alpha-methylstyrene with alkyl (meth)acrylates:

Examples of the alkyl (meth)acrylates which can be copolymerized with styrene and/or alpha-methylstyrene include methyl (meth)acrylate, ethyl (meth)acrylate, butyl (meth)acrylate, propyl (meth)acrylate, amyl (meth)acrylate, 2-ethylhexyl (meth)acrylate, cyclohexyl (meth)acrylate, lauryl (meth)acrylate and stearyl (meth)acrylate. They may be used singly or in combination. Of these, methyl (meth)acrylate, ethyl (meth)acrylate, propyl (meth)acrylate, n-butyl (meth)acrylate, and 2-ethylhexyl (meth)acrylate are preferred.

The copolymerization ratio between styrene and/or alpha-methylstyrene and the alkyl (meth)acrylate, as the weight ratio of styrene and/or alpha-methylstyrene to the alkyl (meth)acrylate, is generally from 50:50 to 90:10, preferably from 60:40 to 85:15. The copolymer preferably has a glass transition temperature (Tg) of about 50 to about 80° C., particularly 50° to 70° C. Preferably, the $\overline{M}w/\overline{M}n$ of the copolymer is generally from 2 to 50, particularly from 10 to 40.

The copolymer may optionally contain a small proportion (preferably not more than 3% by weight based on the weight of the polymer) of units of a third monomer. The third monomer may be a compound having 2 or more copolymerizable unsaturated groups per molecule. Examples include alkylene or di- or poly-alkylene glycol di(meth)acrylates such as ethylene glycol di(meth)acrylate, diethylene glycol di(meth)acrylate, polyethylene glycol di(meth)acrylate, propylene glycol di(meth)acrylate and butanediol di(meth)acrylate; poly(meth)acrylates of polyhydric alcohols such as trimethylolpropane tri(meth)acrylate; and divinylbenzene and divinylnaphthalene. The use of these third monomers gives a copolymer partly having a three-dimensional crosslinked structure. It should be understood that the copolymer of styrene and/or alpha-methylstyrene and the alkyl (meth)acrylate includes those partly having a threedimensional dimensional crosslinked structure.

(2) Polyester Resins

In the present invention, the polyester resins that can be used as a binder may be polyester resins known per se as binders in dry electrophotographic toners. For example, they include polyester resins basically composed of a dicarboxylic acid component and a glycol component and have a softening point of 60 to 160° C., particularly 50 to 130° C., a hydroxyl value of not more than 100 mg KOH/g, an acid value of not more than 20 mg KOH/g, and an $\overline{M}n$ of generally 1,000 to 30,000, preferably 2,000 to 15,000.

To improve toner properties, a three-dimensional crosslinked structure may be introduced partly into such polyester resins by substituting a trihydric or tetrahydric alcohol such as sorbitol, hexanetetrol, dipentaerythritol, glycerol or sucrose and/or a trivalent or tetravalent carboxylic acid for part of the glycol component and/or the dicarboxylic acid component. Alternatively, an epoxy group, a urethane linkage, etc. may be introduced into the polyester resin to provide partly a crosslinked structure or a grafted structure. In order to have positive chargeability intended by this invention exhibited well, it is especially preferred that the polyester resins have an acid value of not more than 3 mg KOH/g.

Examples of the dicarboxylic acid component used in such a polyester resins include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, and linoleic acid, and acid anhydrides and lower alcohol esters thereof. Examples of the glycol component include ethylene glycol, propylene glycol, butylene glycol, neopentyl glycol, hexanediol, diethylene glycol, triethylene glycol, polyethylene glycol, dimethylolbenzene, cyclohexane dimethanol, bisphenol A, and hydrogenated bisphenol A.

(3) Epoxy Resins

The epoxy resin used as a binder in this invention include those which have two or more epoxy groups on an average per molecule. Advantageously, these epoxy resins have a softening temperature of 50° to 170° C., especially 60° to 150° C., a molecular weight of 170 to 8,000, especially 900 to 6,000, and an epoxy equivalent of 150 to 4,000, especially 200 to 3,500.

Examples of such epoxy resins include bisphenol A-type epoxy resins, hydrogenated bisphenol A-type epoxy resins, novolac-type epoxy resins, polyalkylene ether-type epoxy resins, and cycloaliphatic epoxy resins.

(4) The copolymers of styrene and/or alpha-methylstyrene and alkyl (meth)acrylates mentioned in (1) above are especially preferred among the three types of the resin binders described above.

(B) Quaternary ammonium salt group-containing copolymers

As a positive charge controlling agent for imparting good positive charging characteristics to the toner, the present invention uses a specific copolymer containing a quaternary ammonium salt group comprising 65 to 97% by weight of recurring units represented by the following formula

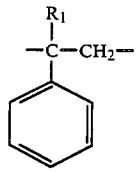

(I)

wherein $R_1$ represents a hydrogen atom or a methyl group, and 35 to 3% by weight of recurring units represented by the formula

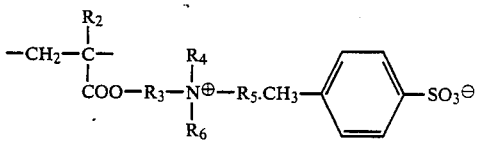

(II)

wherein $R_2$ represents a hydrogen atom or a methyl group, $R_3$ represents an alkylene group, and each of $R_4$, $R_5$ and $R_6$.

This copolymer will be sometimes referred to as the copolymer (B) hereinafter.

The units of formula (I) are derived from styrene, alpha-methylstyrene, or a combination of both. These units are important for dispersing the copolymer (B) in the resinous binder while the copolymer retains good transparency. If the proportion of the units (I) exceeds 97% by weight in the copolymer (B), the compatibility of the copolymer (B) with the binder resin is improved. But the amount of the copolymer (B) to be mixed with the resinous binder to obtain positive charging characteristics required of the toner particles must be increased, and the copolymer (B) adversely affects the fixability of the toner image. If the proportion of the units (I) in the copolymer (B) is less than 80% by weight, the compatibility of the copolymer (B) with the resinous binder is reduced, and the toner particles obtained tend to have reduced moisture resistance.

The recurring units of formula (I) may account for 65 to 97% by weight, preferably 73 to 97% by weight, more preferably 78 to 95% by weight, of the total weight of the copolymer (B).

Part of the recurring units of formula (I) may be replaced by recurring units derived from an alkyl (meth)acrylate represented by the following formula

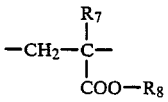

(III)

wherein $R_7$ represents a hydrogen atom or a methyl group, and $R_8$ represents an alkyl group, preferably methyl, ethyl, n- or iso-propyl, n- or iso-butyl, or 2-ethylhexyl.

This can further increase the compatibility of the copolymer (B) with the resin binder. If, however, the proportion of these additional units is too large, the transparency and charging characteristics of the toner tend to be deteriorated. Conveniently, therefore, the proportion of the units (III) is not more than 20% by weight, preferably not more than 15% by weight, more preferably 10 to 5% by weight, based on the weight of the copolymer (B).

The units of formula (II) are derived from a dialkylaminoalkyl (meth)acrylate through a step of quaternization. The proportion of the units (II) may be 35 to 3% by weight, preferably 27 to 3% by weight, more preferably 22 to 5% by weight, based on the weight of the copolymer (B).

In the formation of the units of formula (II), part of the starting monomer may remain unquaternized in the copolymer or may be introduced into the copolymer in the form of an ammonium halide, an intermediate, without any deleterious effect. Hence, the copolymer may contain recurring units of the following formula

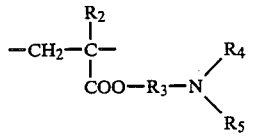

(IV)

or

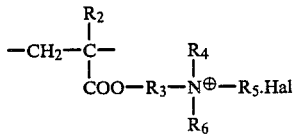

(V)

In the formulae, $R_2$, $R_3$, $R_4$, $R_5$ and $R_6$ are the same as defined hereinabove, and Hal represents a halogen atom. However, if the copolymer (B) contains the units of formula (IV), application of heat in the toner forming step may again result in an unpleasant amine odor in the resulting toner particles. Accordingly, the proportion of the units (IV), or (V) that may be present is not more than 3.5% by weight, preferably not more than 2.0% by weight, more preferably not more than 1.0% by weight, based on the weight of the copolymer (B).

Suitable dialkylaminoalkyl (meth)acrylates from which the units of formula (II) are derived include di(lower alkyl)aminoethyl (meth)acrylates such as dimethylaminoethyl (meth)acrylate, diethylaminoethyl (meth)acrylate, dipropylaminoethyl (meth)acrylate and dibutylaminoethyl (meth)acrylate.

The copolymer (B) can be produced, for example, by (a) copolymerizing styrene and/or alpha-methylstyrene and the dialkylaminoalkyl (meth)acrylate and as required the alkyl (meth)acrylate in the presence of a polymerization initiator, and quaternizing the resulting copolymer with an alkyl p-toluenesulfonate such as methyl p-toluenesulfonate, ethyl p-toluenesulfonate or propyl p-toluenesulfonate, or (b) converting the dialkylaminoalkyl (meth)acrylate into a quaternary ammonium halide in a customary manner using an alkyl halide such as methyl chloride, methyl bromide, ethyl chloride, ethyl bromide, propyl chloride, propyl bromide, butyl chloride or butyl bromide, copolymerizing the quaternary ammonium halide, styrene and/or alpha-methylstyrene and optionally the alkyl (meth)acrylate, and reacting the resulting copolymer with p-toluenesulfonic acid. Generally, the method (a) is preferred because it does not involve formation of by-product hydrogen halide, and hydrogen halide is unlikely to remain in the resulting toner particles.

Examples of the polymerization initiator that can be used in the copolymerization reaction include azobisisobutyronitrile, azobisdimethylvaleronitrile, azobis(2,4-dimethyl-4-methoxyvaleronitrile) and 2-phenylazo)2,4-dimethyl-4-methoxyvaleronitrile). Preferably, the polymerization initiator is used normally in an amount of 0.5 to 5% by weight based on the total amount of the monomeric mixture. The polymerization may be carried out by any method such as solution polymerization, suspension polymerization and bulk polymerization. It is particularly preferred however to adop a solution polymerization method in which the monomeric mixture is copolymerized in an organic solvent such as benzne, toluene, xylene, dioxane, propylene glycol monomethyl ether, ethylene glycol monomethyl ether, ethyl acetate, isopropyl acetate, methyl ethyl ketone, diethyl ketone and methyl isobutyl ketone or a mixture of such an organic solvent with a lower alcohol such as methanol, ethanol, propanol, isopropanol and butanol because the solution polymerization method permits a relatively easy control of the weight average molecular weight of the resulting polymer and an easy operation of reacting the resulting copolymer with an alkyl p-toluenesulfonate or p-toluenesulfonic acid in the next step.

The resulting copolymer is reacted with the alkyl p-toluenesulfonate or p-toluenesulfonic acid by adding the alkyl p-toluenesulfonic acid or p-toluenesulfonic acid to a solution of the copolymer and heating the mixture to a temperature of 60° to 95° C. to give the copolymer (B) used in the invention. The amount of the alkyl p-toluenesulfonate or p-toluenesulfonic acid used may be generally 0.8 to 1 mole, preferably 0.9 to 1 mole, per mole of the units of the dialkylaminoalkyl (meth)acrylate or its quaternary ammonium halide.

The copolymer (B) so produced should have an $\overline{M}w$ in the range of 2,000 to 10,000. If the $\overline{M}w$ of the copolymer is less than 2,000, its environmental resistance is poor, and its chargeability in a high humidity environment is reduced greatly. Furthermore, offset tends to occur during fixation. On the other hand, if its $\overline{M}w$ exceeds 10,000, the compatibility of the copolymer (B) with the binder resin is reduced. Furthermore, since the copolymer (B) cannot be uniformly dispersed in the binder resin, fogging, staining of the photosensitive material and poor fixation occur. The copolymer (B) preferably has an $\overline{M}w$ of 3,000 to 8,000.

The melt viscosity of the copolymer (B), which may affect the kneadability of the copolymer (B) with the resinous binder and the fixability of the resulting toner, is preferably 50 to 10,000, more preferably 100 to 5,000, at 130° C. In the preparation of the toner of this invention, the copolymer (B) is blended in an amount of 1 to 10 parts by weight, preferably 1 to 7 parts by weight, more preferably 1 to 5 parts by weight, per 100 parts by weight of the resin binder. If the amount of the copolymer (B) is less than 1 part by weight, the required amount of positive charge is difficult to obtain, and the amount of charge varies from particle to particle. Consequently, the fixed image obtained becomes obscure, or staining of the photosensitive material becomes heavy. On the other hand, if it is larger than 10 parts by weight, the copolymer (B) has reduced environmental resistance and compatibility, and such defects as offset and staining of the photosensitive material occur.

(C) Coloring agent

The coloring agent used in the toner of this invention is not particularly restricted, and can be selected from a wide range of coloring agents. Examples include carbon black, nigrosine dye (C. I. No. 50415B), Aniline Blue (C. I. No. 50405), Chalcoil Oil Blue (C. I. No. 14090), Chrome Yellow (C. I. No. 14090), Ultramarine Blue (C. I. No. 77103), Du Pont Oil Red (C. I. No. 26105), Quinoline Yellow (C. I. No. 47005), Methylene Blue Chloride (C. I. No. 52015), Phthalocyanine Blue (C. I. No. 74160), Malachite Green Oxalate (C. I. No. 42000), Lamp Black (C. I. No. 77266), Rose Bengale (C. I. No. 45435), and mixture of these. The coloring agent is blended in a proportion required to form a visible image of a sufficient density. Usually, it is used in an amount of 1 to 20 parts by weight, preferably 2 to 7 parts by weight, per 100 parts by weight of the resinous binder.

(D) Other additives

In addition to the three essential ingredients, i.e. the resinous binder, the copolymer (B) and the coloring agent, the toner of this invention may further contain a property improver for further improving offset resistance and optionally have releasability. Examples are higher fatty acids, higher fatty acid metal salts, natural or synthetic waxes, higher fatty acid esters or partially saponified products thereof, alkylenebis-fatty acid amides, fluorine resins, and silicone resins. The amount of the property improver is generally 1 to 10 parts by weight per 100 parts by weight of the resinous binder.

In order to retain toner flowability and storage stability, the surface of the toner particles may be treated with 1 to 5 parts, per 100 parts by weight of the toner particles, of colloidal silica, hydrophobic silica, etc.

In the case of a one-component toner, a magnetic powder is melt-kneaded with the above resin binder, the copolymer (B) and the coloring agent and optionally other additives. Examples of the magnetic powder used are ferromagnetic metals such as iron, cobalt and nickel, alloys of these metals and compounds containing these elements, such as ferrite and magnetite, and alloys which do not contain ferromagnetic elements but become ferromagnetic by being subjected to a suitable heat treatment, such as Heuslor's alloys containing manganese and copper such as manganese-copper-aluminum and manganese-copper-tin, and chromium dioxide. The magnetic powder is uniformly dispersed in the resinous binder in the form of a fine powder having an average particle diameter of 0.1 to 1 micron. The amount of the magnetic powder added is generally 20 to 70 parts by weight, preferably 40 to 70 parts by weight, per 100 parts by weight of the resinous binder.

Preparation of a toner

The toner of this invention can be prepared by fully mixing the components mentioned in (A) to (D) by a mixer such as a Henschel mixer or a ball mill, melt-kneading the mixture by a hot kneader such as a hot roll, a kneader, or an extruder, cooling and solidifying the mixture, pulverizing the solidified mixture by a pulverizer such as a hammer mill or a jet mill, and classifying the pulverized mixture and recovering toner particles having an average particle diameter of preferably 5 to 20 microns.

Alternatively, the toner of the invention may be prepared by spray-drying an organic solvent solution of the above components dissolved or dispersed therein, or by mixing the monomeric mixture which is to constitute the resinous binder with the remaining components to form an emulsion, and thereafter subjecting the emulsion to copolymerization.

The following examples illustrate the present invention more specifically. In these examples, the copolymerization or mixing ratios of the components are by weight.

EXAMPLE 1

Production of a resinous binder (A-1):

A 10-liter reactor equipped with a stirrer, a condenser and a thermometer was charged with 1,000 ml of a 1.5% by weight aqueous solution of polyvinyl alcohol (saponified to a degree of 90%), and with stirring, a mixture of 1200 g of styrene, 200 g of n-butyl methacrylate, 10 g of ethylene glycol dimethacrylate and 60 g of benzoyl peroxide was fed into the reactor. The reaction mixture was reacted at 80° C. for 2 hours, at 90° C. for 2 hours, and further at 120° C. for two hours. The product was cooled, washed, dehydrated and dried to give a resinous binder (1) having a Tg of 63° C., an $\overline{M}w$ of 185,000 and an $\overline{M}w/\overline{M}n$ of 17.3.

Production of a copolymer (B-1):

A 2-liter flask equipped with a stirrer, a condenser, a thermometer and a nitrogen introducing tube was charged with 300 g of methanol, 100 g of toluene, 540 g of styrene, 60 g of dimethylaminoethyl methacrylate and 12 g of azobisdiisobutyronitrile. With stirring, the reaction mixture was subjected to solution polymerization at 70° C. for 10 hours while introducing nitrogen. The resulting polymer solution was cooled, and by adding 150 g of toluene, 100 g of methanol and 710 g of p-toluenesulfonic acid, the polymer was quaternized at 70° C. for 5 hours. The contents were taken out from the flask, and heated to 100° C. to evaporate the solvent under reduced pressure and obtain a copolymer (B-1).

Preparation of a toner:

One hundred parts of the resinous binder (A-1) and 5 parts of the copolymer (B-1) were mixed for 10 minutes by a mixer, and melt-kneaded by a laboplasto mill (made by Toyo Seiki Co., Ltd.; set temperature 150° C., the rotating speed 70 rpm). The kneaded mixture was finely pulverized by a jet mill. The particles were air-classified to collect particles having a particle diameter of 5 to 25 microns as non-colored toner particles.

The properties of the resulting non-colored toner particles were evaluated by the following methods, and the results are shown in Table 2.

(1) Compatibility

The toner particles were extruded by a melt indexer and molded into a solid cylinder having a diameter of about 5 mm. The cylinder was visually observed sideways, and its compatibility was evaluated by its transparency.

(2) Chargeability

The toner particles and a spherical iron oxide powder were mixed at a ratio of 3:97, and the mixture was triboelectrically charged at 20° C. and 65% RH for a fixed period of time (10 minutes, 60 minutes, 180 minutes). The amount of the charge (μC/g) was measured by using a blow off powder charge measuring device made by Toshiba Chemical Co., Ltd.

(3) Ratio of the amount of the residual charge

The toner particles (the amount of charge is designated as $C_0$) which had been triboelectrically charged for 180 minutes in the procedure described in (2) above were left to stand for 14 hours in an atmosphere kept at a temperature of 35° C. and a relative humidity of 85%. The amount of charge (μC/g) of these toner particles was measured as in (2) above (the amount of charge at this time is designated as $C_1$). The ratio of the amount of the remaining charge was calculated in accordance wilth the following equation.

$$\text{Ratio (\%) of the amount of the residual charge} = \frac{C_1}{C_0} \times 100$$

EXAMPLE 2

One hundred parts of the resin binder (A-1) produced in Example 1 and 7 parts of the copolymer (B-1) produced in Example 1 were mixed with 5 parts of Mitsubishi Carbon #40, and worked up in the same way as in Example 1 to form toner particles having a particle diameter of 5 to 25 microns. The amount of charge and the ratio of the amount of thee residual charge of the toner particles were measured as in Example 1.

The electrophotographic properties of the toner particles were evaluated by the following method. The results are summarized in Table 2.

(4) Electrophotographic properties

A copying test was performed on the toner particles by a commercial copying machine adapted for positively chargeable toners. Fogging, staining of the photosensitive material and the state of offset were observed visually.

EXAMPLE 3

One hundred parts of the resin binder (A-1) and 3 parts of the copolymer (B-1) produced in Example 1 were mixed with 3 parts of Kayaset Red 130 (a product of Nippon Kayaku Co., Ltd.), and colored toners were produced from the mixture as in Example 1. The toners were evaluated as in Examples 1 and 2, and the results are shown in Table 2.

By using the toner particles, a copied image was formed on a transparent polyester sheet for an overhead projector. When it was projected onto an overhead projector screen, a red image of a haze-free clear hue could be reproduced.

EXAMPLE 4

Production of copolymer (B-2):

The same reactor as used in Example 1 was charged with 582 g of styrene, 18 g of diethylaminoethyl methacrylate, 9.0 g of a polymerization initiator and 105 g of methyl ethyl ketone. The mixture was heated for 12 hours, and 295 g of methyl ethyl ketone and 15.4 g of methyl p-toluenesulfonate were added. The mixture was reacted at 80° C. for 5 hours to give a copolymer (B-2) having an $\overline{M}w$ of 5,000.

Preparation of a toner:

Colored toner particles were prepared as in Example 1 from 8 parts of the resulting copolymer (B-2), 100 parts of the binder resin (A-1) produced in Example 1 and 3 parts of Kayaset Yellow AG (a product of Nippon Kayaku Co., Ltd.), and evaluated as in Examples 1 and 2. The results are shown in Table 2.

EXAMPLE 5

Production of copolymer (B-3):

By the same method as in Example 4, a polymer solution was produced by using 51 g of styrene, 90 g of diethylaminoethyl methacrylate and 12 g of a polymerization initiator. The polymer was quaternized by adding 295 g of methyl ethyl ketone and 90 g of methyl p-toluenesulfonate to the polymer solution to produce a copolymer (B-3) having an $\overline{M}w$ of 5,600.

Preparation of a toner:

Colored toners were prepared as in Example 1 from 2.5 parts of the resulting copolymer (B-3), 100 parts of the binder resin (A-1) obtained in Example 1, and 3 parts of Kayaset Blue N (a product of Nippon Kayaku Co., Ltd.), and evaluated as in Examples 1 and 2. The results are shown in Table 2.

EXAMPLE 6

Production of a copolymer (B-4):

A polymer was produced as in Example 1 by using 480 g of styrene, 120 g of dimethylaminoethyl methacrylate and 6.0 g of a polymerization initiator. The polymer was quaternized by adding 150 g of toluene, 100 g of methanol and 113.7 g of methyl p-toluenesulfonate to give a copolymer (B-4) having an $\overline{M}w$ of 9,700.

Preparation of a toner:

Colored toner particles were prepared as in Example 1 from 1.5 parts of the copolymer (B-4), 100 parts of the resinous binder (A-1) obtained in Example 1 and 3 parts of Kayaset Blue N, and then evaluated as in Examples 1 and 2. The results are shown in Table 2.

COMPARATIVE EXAMPLES 1-8

Styrene, diethylaminoethyl methacrylate and a polymerization initiator were blended in the proportions shown in Table 1, and copolymers (Q-1 to Q-8) were produced as in Example 1. Colored toners corresponding to the copolymers (Q-1 to Q-8) were prepared as in Example 1 from the copolymers Q-1 to Q-8 and the binder resin (A-1) obtained in Example 1 in the proportions indicated in Table 1 and 3 parts of Kayaset Blue N. The toners were evaluated as in Examples 1 and 2, and the results are shown in Table 2.

TABLE 1

| | Polymer (Q) | | | | | |
|---|---|---|---|---|---|---|
| Comparative Example | Styrene (parts) | DEAEM (parts) (*) | PTS-Me (moles) (**) | $\overline{M}w$ | Resinous binder (A-1) (parts) | Polymer (Q) (parts) |
| 1 | 98.5 | 1.5 | 1.0 | 4700 | 100 | 12 |
| 2 | 85 | 15 | 1.0 | 7400 | 100 | 1 |
| 3 | 95 | 5 | 0.8 | 12100 | 100 | 8 |
| 4 | 95 | 5 | 0.8 | 1900 | 100 | 8 |
| 5 | 77.5 | 22.5 | 1.0 | 6700 | 100 | 3 |
| 6 | 99 | 1.0 | 1.0 | 5300 | 100 | 10 |
| 7 | 90 | 10 | 1.1 | 5200 | 100 | 0 |
| 8 | 90 | 10 | 0.7 | 5100 | 100 | 0 |

(*): DEAEM = diethylaminoethyl methacrylate
(**): PTS-Me = methyl p-tolenesulfonate

TABLE 2

| | Amount of charge (μC/g) 10 min. | 60 min. | 180 min. | Ratio of the amount of the residual charge (%) | Electrophotographic properties: Fogging | Staining of the photosensitive material | Offset | Compatibility |
|---|---|---|---|---|---|---|---|---|
| Example | | | | | | | | |
| 1 | 21.3 | 22.2 | 22.7 | 94.1 | — | — | — | ○ |
| 2 | 19.2 | 20.2 | 20.9 | 93.8 | ○ | ○ | ○ | — |
| 3 | 22.4 | 23.3 | 23.5 | 94.0 | ○ | ○ | ○ | ○ |
| 4 | 19.5 | 19.5 | 19.7 | 94.4 | ○ | ○ | ○ | ○ |
| 5 | 23.4 | 23.1 | 23.7 | 89.5 | ○ | ○ | ○ | ⊛ |
| 6 | 19.2 | 20.4 | 21.2 | 87.6 | ⊛ | ○ | ○ | ⊛ |
| Comparative Example | | | | | | | | |
| 1 | 24.7 | 23.2 | 21.3 | 82.3 | ⊛ | ⊛ | Δ | ○ |
| 2 | 16.8 | 17.4 | 16.4 | 93.6 | Δ | ⊛ | ○ | ○ |
| 3 | 22.6 | 22.4 | 22.7 | 81.2 | ⊛ | ○ | Δ | Δ |
| 4 | 24.0 | 22.7 | 20.5 | 73.1 | Δ | ⊛ | Δ | ○ |
| 5 | 21.0 | 21.3 | 21.4 | 70.5 | Δ | ○ | Δ | X |
| 6 | 22.4 | 21.9 | 22.3 | 87.4 | ⊛ | ⊛ | ○ | ○ |
| 7 | 20.6 | 18.2 | 17.5 | 68.0 | X | X | ⊛ | ○ |
| 8 | 21.4 | 22.3 | 22.4 | 72.6 | ○ | ○ | ○ | ○ |

The symbols in the above and subsequent tables have the following meanings.

Electrophotographic properties

○: very good
⊛: good
Δ: poor
X: very poor

Compatibility

○: forming a colorless transparent mixture
⊛: forming a transparent mixture with a slight tint of yellow
Δ: forming a whitely hazy mixture
X: non-compatible in a whitely turbid condition

EXAMPLE 7

Production of a resinous binder (A-2):

Dimethyl terephthalate (253 parts), 136 parts of dimethyl isophthalate and 186 parts of ethylene glycol were fed into a four-necked round-bottomed flask equipped with a thermometer, a stainless steel stirrer, a glass tube for introduction of nitrogen and a flow-down type condenser. Nitrogen gas was introduced into the flask to maintain the inside of the flask in an inert atmosphere. The temperature was raised, and 1.4 parts of tetrabutyl titanate was added with stirring. The reaction temperature was gradually raised while removing methanol formed by the esterinterchange reaction was removed. The reaction mixture was finally maintained at 240° C. to complete the ester-interchange reaction.

Then, at 240° C., the pressure was reduced to below 5 mmHg over the course of 1 hour. The ester-interchange reaction product was then polycondensed for 1 hour to obtain a polyester (I).

The polyester (I) was composed of aromatic dicarboxylic acid units consisting of 65 mole % of terephthalic acid units and 55 mole % of isophthalic acid units and 100 mole % of ethylene glycol units, and had an $\overline{Mn}$ of 12,000, an acid value of less than 1 mg KOH/g and a hydroxyl value of 9 mg KOH/g.

Glycerol (13 parts) was added to the polyester (I) at 240° C. in an atmosphere of nitrogen under atmospheric pressure, and the mixture was reacted for 1 hour to form a polyester (II).

The polyester (II) had an acid value of less than 1 mg KOH/g, a hydroxyl value of 51 mg KOH/g, an $\overline{Mn}$ of 1,000, and a Tg of 42° C.

One hundred parts of the resulting polyester and 6 parts of Coronate EH (hexamethylene diisocyanate with an NCO content of 21%; a product of Nippon Polyurethane Co., Ltd.) were preliminarily dispersed by a Henschel mixer (supplied by Mitsui Miike Seisakusho Co., Ltd.) and reacted at 190° C. by a twin-screw kneading extruder supplied by Ikegai Tekko Co., Ltd.; the screws adapted to turn in the same direction) with an average resin residence time of 4 minutes in the extruder to produce a polyester resin having an acid value of less than 1 mg KOH/g, a hydroxyl value of 81 mg KOH/g, a Tg of 51° C. and a softening temperature of 130° C.

Preparation of a toner:

One hundred parts of the resin binder (A-2) prepared above and 5 parts of the copolymer (B-1) produced in Example 1 were melt-kneaded by a laboplasto mill (made by Toyo Seiki Co., Ltd1; set temperature 120° C., rotating speed 80 rpm), pulverized and classified to obtain a noncolored toner. The toner assumed a pale yellow color inherent to the resinous binder (A-2), but the transparency of the toner was quite satisfactory. The toner was also evaluated as in Example 1. The results are shown in Table 3.

EXAMPLE 8

A non-colored toner was prepared by treating 7 parts of the copolymer (B-4) produced in Example 6 and 100 parts of the resin binder (A-2) by the same technique as in Example 7. The toner was evaluated as in Example 1, and the results are shown in Table 3.

EXAMPLE 9

A non-colored toner was prepared by treating 8 parts of the copolymer (B-1) produced in Example 1 and 100 parts of Epikote 1007 (a tradename for an epoxy resin produced by Shell Chemical Co.) by the same technique as in Example 7. The toner assumed a color inherent to the resin, but its transparency was satisfactory. The toner was also evaluated as in Example 1, and the results are shown in Table 3.

EXAMPLE 10

A non-colored toner was prepared and evaluated in the same way as in Example 8 except that Epikote 1009 (epoxy resin produced by Shell Chemical Co., Ltd.) was used instead of the resinous binder (A-2). The results are shown in Table 3.

TABLE 3

| Example | Amounts of charge 10 min. | 60 min. | 180 min. | Ratio of the amount of the residual charge (%) | Compatibility |
|---|---|---|---|---|---|
| 7 | 18.5 | 18.6 | 19.3 | 86.3 | ○ |
| 8 | 20.2 | 21.2 | 20.8 | 83.1 | ⊚ |
| 9 | 17.9 | 18.4 | 18.6 | 93.2 | ⊚ |
| 10 | 18.5 | 19.2 | 19.3 | 92.9 | ⊚ |

EXAMPLE 11

Production of a copolymer (B-5):

A 2-liter flask equipped with a stirrer, a condenser, a thermometer, a nitrogen introduction tube was charged with 300 g of methanol, 100 g of toluene, 570 g of styrene, 30 g of a quaternary methyl chloride salt of dimethylaminoethyl methacrylate and 10 g of azobisdimethylvaleronitrile, and the mixture was subjected to solution polymerization with stirring at 65° C. for 19 hours while introducing nitrogen into the flask. The resulting polymer solution was cooled, and 150 g of toluene, 100 g of methanol and 24.8 g of p-toluenesulfonic acid were added and the polymer was converted to a salt at 50° C. for 2 hours with stirring. The contents were taken out from the flask and the solvent was evaporated under reduced pressure. The product was pulverized by a jet mill to produce a copolymer (B-5) having an $\overline{M}w$ of 3,500.

Preparation of a toner:

One hundred parts of the resinous binder (A-1) produced in Example 1 and 5 parts of the copolymer (B-5) were mixed for 10 minutes by a mixer, then melt-kneaded by a roll mill, finely pulverized by a jet mill, and air-classified to form non-colored toner particles having a particle diameter of 5 to 25 microns.

The non-colored toner particles obtained were evaluated as in Examples 1 and 2, and the results are show in Table 5.

EXAMPLE 12

Toner particles having a particle diameter of 5 to 25 microns were prepared as in Example 11 from 100 parts of the resinous binder (A-1) obtained in Example 1, 4 parts of the copolymer (B-5) obtained in Example 11, and 5 parts of Mitsubishi Carbon #40. The resulting toners were evaluated as in Examples 1 and 2, and the results are shown in Table 5.

EXAMPLE 13

Colored toner particles were produced as in Example 11 from 100 parts of the resinous binder (A-1) obtained in Example 1, 3 parts of the copolymer (B-5) obtained in Example 10 and 5 parts of Kayaset Red 130 (a product of Nippon Kayaku Co., Ltd.), and then evaluated as in Examples 1 and 2. The results are shown in Table 5.

By using the toner particles, a copied image was formed on a transparent polyester sheet for an overhead projector. When it was projected onto an overhead projector screen, a red image of a haze-free clear hue could be reproduced.

EXAMPLE 14

Production of a copolymer (B-6):

Styrene (510 g), 90 g of an n-butyl bromide quaternary salt of diethyaminoethyl metahcrylate and 9.0 g of a polymerization initiator were subjected to copolymerization in the same way as in Example 11, and then by adding 100 g of methyl ethyl ketone, 100 g of methanol and 47.7 g of p-toluenesulfonic acid, the polymer was converted into a salt to give a copolymer (B-6) having an $\overline{M}w$ of 5,300.

Preparation of a toner:

Colored toner particles were prepared as in Example 11 from 2 parts of the copolymer (B-6), 100 parts of the resinous binder (A-1) obtained in Example 1 and 3 parts of Kayaset Yellow AG (a product of Nippon Kayaku Co., Ltd.), and evaluated as in Examples 1 and 2. The results are shown in Table 5.

EXAMPLE 15

Production of a copolymer (B-7):

A polymer solution was prepared as in Example 11 by using 588 g of styrene, 12 g of an n-butyl chloride quaternary salt of diethylaminoethyl methacrylate and 6 g of a polymerization initiator, and by adding 100 g of ethyl acetate, 100 g of methanol and 6.7 g of p-toluenesulfonate, the polymer was converted into a salt to form a copolymer (B-7) having an $\overline{M}w$ of 8,500.

Preparation of a toner:

Colored toner particles were prepared from 10 parts of the copolymer (B-7), 100 parts of the resinous binder (A-1) obtained in Example 1 and 3 parts of Kayaset Blue N (a product of Nippon Kayaku Co., Ltd.), and evaluated as in Examples 1 and 2. The results are shown in Table 5.

EXAMPLE 16

Production of a copolymer (B-8):

By the same method as in Example 11, a polymer obtained by using 540 g of styrene, 60 g of a methyl chloride quaternary salt of dimethylaminoethyl methacrylate and 7.5 g of polymerization initiator was converted into a salt by adding 150 g of toluene, 100 g of methanol and 42.3 g of p-toluenesulfonic acid to produce a copolymer (B-8) having an $\overline{M}w$ of 5,600.

Preparation of a toner:

Colored toner particles were prepared by using 7 parts of the copolymer (B-8), 100 parts of the resinous binder (a) obtained in Example 1, and 3 parts of Kayaset Blue N, and evaluated as in Examples 1 and 2. The results are shown in Table 5.

COMPARATIVE EXAMPLES 9–16

Styrene, a methyl chloride quaternary salt of dimethylaminoethyl methacrylate and a polymerization initiators were mixed in the proportions shown in Table 4, and as in Example 11, copolymers (Q-9 to Q-16) were produced. Colored toners corresponding to the copolymers (Q-9 to Q-16) were preapred from the copolymers Q-9 to Q-16 and the resinous binder (A-1) obtained in Example 1 in the proportions indicated in Table 4 and 3 parts of a coloring agent (Kayaset Blue N). The toners were evaluated as in Examples 1 and 2, and the results are shown in Table 5.

TABLE 4

| Comparative Example | Polymer (Q) Styrene (parts) | DMAEM (parts) (*) | Polymerization initiator (parts) | PTS (moles) (**) | $\overline{M}w$ | Resinous binder (A-1) (parts) | Polymer (Q) (parts) |
|---|---|---|---|---|---|---|---|
| 9 | 98 | 2 | 1.7 | 0.9 | 3400 | | |
| 10 | 95 | 5 | 1.6 | 0.9 | 5600 | 100 | 1 |
| 11 | 97 | 3 | 4.5 | 1.0 | 1800 | 100 | 8 |
| 12 | 97 | 3 | 0.5 | 1.0 | 11800 | 100 | 8 |
| 13 | 99 | 1 | 1.6 | 1.0 | 4700 | 100 | 10 |
| 14 | 80 | 20 | 1.0 | 1.0 | 6500 | 100 | 5 |
| 15 | 97 | 3 | 1.6 | 1.2 | 5000 | 100 | 8 |
| 16 | 97 | 3 | 1.6 | 0.7 | 4400 | 100 | 8 |

(*): DMAEM = dimethylaminoethyl methacrylate
(**): PTS = p-tolenesulfonic acid

COMPARATIVE EXAMPLE 17

Colored toner particles were prepared as in Example 10 by using 100 parts of the resinous binder (A-1) obtained in Example 1, 1 part of cetyl trimethyl ammonium bromide (a colorless positive charge controlling agent) and 3 parts of Kayaset Blue N, and evaluated as in Examples 1 and 2. The results are shown in Table 5.

TABLE 5

| | Amount of charge (μC/g) 10 min. | 60 min. | 180 min. | Ratio of the amount of the residual charge (%) | Electrophotographic properties: Fogging | Staining of the photosensitive material | Offset | Compatibility |
|---|---|---|---|---|---|---|---|---|
| Example | | | | | | | | |
| 11 | 20.4 | 22.2 | 23.5 | 93.2 | — | — | — | ○ |
| 12 | 18.3 | 19.0 | 19.8 | 92.8 | ○ | ○ | ○ | — |
| 13 | 14.4 | 15.0 | 16.8 | 94.0 | ○ | ○ | ○ | ○ |
| 14 | 17.0 | 18.2 | 17.4 | 92.0 | ⊙ | ○ | ○ | ⊙ |
| 15 | 18.6 | 19.2 | 20.4 | 93.2 | ○ | ○ | ○ | ○ |
| 16 | 23.5 | 24.4 | 24.8 | 92.5 | ⊙ | ⊙ | ○ | ○ |
| Comparative Example | | | | | | | | |
| 9 | 22.5 | 24.5 | 25.3 | 81.9 | Δ | ○ | X | ○ |
| 10 | 7.2 | 7.8 | 8.4 | 94.1 | X | X | ○ | ○ |
| 11 | 18.4 | 19.2 | 20.3 | 82.1 | ○ | ○ | X | ○ |
| 12 | 18.0 | 19.2 | 20.0 | 91.2 | Δ | Δ | ○ | X |
| 13 | 11.1 | 12.1 | 12.8 | 92.2 | X | X | X | ○ |
| 14 | 22.9 | 23.4 | 23.9 | 80.0 | X | X | ○ | X |
| 15 | 21.2 | 22.3 | 22.9 | 77.9 | ○ | ○ | ○ | ○ |
| 16 | 20.3 | 21.2 | 23.5 | 78.3 | ○ | ○ | ○ | ○ |
| 17 | 15.0 | 16.8 | 14.8 | 65.7 | Δ | Δ | ○ | X |

The symbols in the table have the same meanings as the footnote to Table 2.

The positively chargeable toner for electrophotography provided by this invention has stable charging characteristics, changes little in the amount of charge even by environmental changes, and has excellent electrophotographic properties.

In the mixing of the positive charge controlling agent and the resinous binder, they have good compatibility as shown by the colorless or pale-colored transparent mixture obtained. Furthermore, for color copying, a colored toner of a clear hue can be obtained.

The advantages of the invention are therefore excellent.

What is claimed is:

1. A positively chargeable toner for use in dry electrophotography, said toner comprising (A) a resinous binder composed of at least one resin selected from copolymers of styrene and/or alphamethylstyrene with alkyl (meth)acrylates, polyester resins and epoxy resins, (B) 1 to 10 parts by weight, per 100 parts by weight of the resinous binder, of a copolymer containing a quaternary ammonium salt group, said copolymer having a weight average molecular weight of from 2,000 to 10,000 and composed of 65 to 97% by weight of recurring units represented by the formula (I)

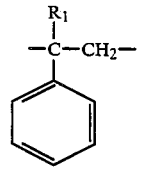

wherein $R_1$ represents a hydrogen atom or a methyl group, and 35 to 3% by weight of recurring units represented by the formula (II)

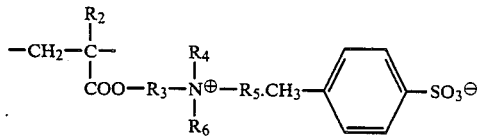

wherein $R_2$ represents a hydrogen atom or a methyl group, $R_3$ represents an alkylene group, and each of $R_4$, $R_5$ and $R_6$ represents an alkyl group, and (C) a coloring agent.

2. The toner of claim 1 wherein the copolymer of styrene and/or alpha-methylstyrene and the alkyl (meth)acrylate has a glass transition temperature of about 50 to about 80° C.

3. The toner of claim 1 wherein the copolymer of styrene and/or alpha-methylstyrene and the alkyl (meth)acrylate has a weight average molecular weight-/number average molecular weight ratio of from 2 to 50.

4. The toner of claim 1 wherein the copolymer of styrene and/or alpha-methylstyrene and the alkyl (meth)acrylate partly has a three-dimensional cross-linked structure.

5. The toner of claim 1 wherein the polyester resins have a softening temperature in the range of 50° to 160° C., a hydroxyl value of not more than 100 mg KOH/g and an acid value of not more than 20 mg KOH/g.

6. The toner of claim 1 wherein the polyester resins have a number average molecular weight of 1,000 to 30,000.

7. The toner of claim 1 wherein the polyester resins partly have a three-dimensional crosslinked structure.

8. The toner of claim 1 wherein the epoxy resins have a softening temperature of 50° to 170° C., a molecular weight of 700 to 8,000 and an epoxy equivalent in the range of 150 to 4,000.

9. The toner of claim 1 wherein the copolymer containing a quaternary ammonum salt group comprises 65 to 97% by weight of the recurring units of formula (I) and 35 to 3% by weight of the recurring units of formula (II).

10. The toner of claim 1 wherein the copolymer containing a quaternary ammonium salt group further comprises not more than 20% by weight of recurring units derived from an alkyl (meth)acrylate represented by the following formula

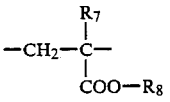

(III)

wherein $R_7$ represents a hydrogen atom or a methyl group, and $R_8$ represents an alkyl group.

11. The toner of claim 1 wherein the copolymer containing a quaternary ammonium salt group has a weight average molecular weight in the range of 3,000 to 8,000.

12. The toner of claim 1 wherein the copolymer containing a quaternary ammonium salt group has a melt viscosity at 130° C. of 50 to 10,000 poises.

13. The toner of claim 1 wherein the amount of the copolymer containing a quaternary ammonium salt group is 1 to 7 parts by weight per 100 parts by weight of the resinous binder.

14. The toner of claim 1 wherein the amount of the coloring agent is 1 to 20 parts by weight per 100 parts by weight of the resinous binder.

15. The toner of claim 1 which further comprises a property improver.

* * * * *